US005819860A

United States Patent [19]

Newton et al.

[11] Patent Number: 5,819,860

[45] **Date of Patent: *Oct. 13, 1998**

[54] ROTARY DRILL BITS

[75] Inventors: Alex Newton, Houston, Tex.; Steven Taylor, Cheltenham, England; Andrew Murdock, Stonehouse, England; John M. Clegg, Bristol, England

[73] Assignee: Camco International Inc., Houston, Tex.

[ * ] Notice: The term of this patent shall not extend beyond the expiration date of Pat. No. 5,671,818.

[21] Appl. No.: 834,440

[22] Filed: Apr. 16, 1997

Related U.S. Application Data

[63] Continuation of Ser. No. 541,774, Oct. 10, 1995, Pat. No. 5,671,818.

[30] Foreign Application Priority Data

| | | | |
|---|---|---|---|
| Oct. 15, 1994 | [GB] | United Kingdom | 9420838 |
| Sep. 8, 1995 | [GB] | United Kingdom | 9518267 |

[51] Int. Cl.[6] ..... E21B 10/60

[52] U.S. Cl. ..... 175/393; 175/399

[58] Field of Search ..... 175/393, 428, 175/399, 430, 400, 417, 429, 431

[56] References Cited

U.S. PATENT DOCUMENTS

| | | | |
|---|---|---|---|
| 3,099,324 | 7/1963 | Kucera et al. | 175/339 |
| 3,111,179 | 11/1963 | Albers et al. | 175/393 |
| 3,743,036 | 7/1973 | Feenstra et al. | 175/330 |
| 3,951,220 | 4/1976 | Phillips, Jr. et al. | 175/393 |
| 4,440,247 | 4/1984 | Sartor | 175/393 |
| 4,577,706 | 3/1986 | Barr | 175/329 |
| 4,618,010 | 10/1986 | Falgout, Sr. et al. | 175/329 |
| 4,733,735 | 3/1988 | Barr et al. | 175/417 X |
| 5,029,657 | 7/1991 | Mahar et al. | 175/393 |
| 5,145,017 | 9/1992 | Holster et al. | 175/393 X |
| 5,199,511 | 4/1993 | Tibbitts et al. | 175/65 |
| 5,244,039 | 9/1993 | Newton, Jr. et al. | 175/431 |
| 5,417,296 | 5/1995 | Murdock | 175/393 |
| 5,452,628 | 9/1995 | Montgomery Jr. et al. | 76/105.2 |

FOREIGN PATENT DOCUMENTS

| | | | |
|---|---|---|---|
| 713998 | 8/1954 | United Kingdom . | |
| 2298666 | 9/1996 | United Kingdom | E21B 10/46 |
| WO 94/12760 | 6/1994 | WIPO | E21B 10/64 |

*Primary Examiner*—Frank Tsay
*Attorney, Agent, or Firm*—Fletcher, Yoder & Edwards

[57] ABSTRACT

A rotary drill bit for use in drilling holes in subsurface formations comprises a bit body having a leading face and a gauge region, a number of blades formed on the leading face of the bit and extending outwardly away from the axis of the bit so as to define between the blades a number of fluid channels leading towards the gauge region, a number of cutting elements mounted side-by-side along each blade, and a number of nozzles in the bit body for supplying drilling fluid to the fluid channels for cleaning and cooling the cutting elements. In at least one of the fluid channels, adjacent the gauge region, is an opening into an enclosed passage which passes internally through the bit body to an outlet which, in use, communicates with the annulus between the drill string and the wall of the borehole being drilled. The portion of the gauge region outwardly of the opening comprises a bearing surface which, in use bears against the wall of the bore hole and extends across the width of the channel.

52 Claims, 3 Drawing Sheets

ROTARY DRILL BITS

This application is a Continuation of application Ser. No. 08/541,774 filed Oct. 10, 1995, now U.S. Pat. No. 5,671, 818.

BACKGROUND OF THE INVENTION

The invention relates to rotary drill bits for use in drilling holes in subsurface formations, and of the kind comprising a bit body having a leading face and a gauge region, a plurality of blades formed on the leading face of the bit and extending outwardly away from the axis of the bit towards the gauge region so as to define between the blades a plurality of fluid channels leading towards the gauge region, a plurality of cutting elements mounted along each blade, and a plurality of nozzles in the bit body for supplying drilling fluids to the channels for cleaning and cooling the cutting elements.

The invention is particularly, but not exclusively, applicable to drill bits in which some or all of the cutters are preform (PDC) cutters each formed, at least in part, from polycrystalline diamond. One common form of cutter comprises a tablet, usually circular or part circular, made up of a superhard table of polycrystalline diamond, providing the front cutting face of the element, bonded to a substrate which is usually of cemented tungsten carbide.

The bit body may be machined from solid metal, usually steel, or may be moulded using a powder metallurgy process in which tungsten carbide powder is infiltrated with metal alloy binder inner furnace so as to form a hard matrix.

In the normal prior art construction the gauge region of the drill bit is formed by a plurality of kickers which are spaced apart around the outer periphery of the bit body and are formed with bearing surfaces which in use, bear against the wall of the bore hole. The kickers generally form continuations of the respective blades, and the spaces between the kickers define junk slots with which the channels between the blades communicate. Drilling fluid flowing outwardly along each channel flows into the junk slot at the end of the channel and passes upwardly through the junk slot into the annulus between the drill string and the wall of the borehole.

While such PDC bits have been very successful in drilling relatively soft formations, they have been less successful in drilling harder formations, and soft formations which include harder or occlusions or stringers. Although good rates of penetration are possible in harder formations, the PDC cutters may suffer accelerated wear and bit life can be too short to be commercially acceptable.

Studies have suggested that the rapid wear of PDC bits in harder formations may be due to chipping of the cutters as a result of impact loads caused by vibration of the drill bit. One of the most harmful types of vibration can be attributed to a phenomenon called "bit whirl".

It is believed that the stability of such a drill bit, and its ability to resist vibration, may be enhanced by increasing the area of the bearing surfaces on the gauge region which engage the wall of the borehole. In the prior art designs, however, the area of engagement can only be increased by increasing the length and/or width of the bearing surfaces on the kickers. It may be undesirable to increase the length of the bearing surfaces since this may lead to difficulties in steering the bit in steerable drilling systems. Similarly, increasing the circumferential width of the bearing surfaces necessarily reduces he width of the junk slots between the bearing surfaces, and this may lead to less than optimum hydraulic flow of drilling fluid along the channels and over the cutters, and may lead to blockage of the junk slots and channels by debris.

The present invention provides arrangements whereby the bearing surface area of the gauge region of a drill bit of the kind first referred to may be increased without the above-mentioned disadvantages, and which may also give rise to other advantages.

SUMMARY OF THE INVENTION

According to one aspect of the present invention, there is provided a rotary drill bit for drilling a borehole. The drill bit includes a bit body having a leading face and a peripheral gauge region. An opening is disposed in the leading face. The opening leads to a passage which passes internally through the bit body between the opening and an outlet. A bearing surface is disposed at a portion of the gauge region outwardly from the opening.

In accordance with another aspect of the present invention, there is provided a rotary drill bit. The drill bit includes a bit body having a leading face and a peripheral gauge region. The leading face is arranged to accept a plurality of cutting elements thereon and to accept at least one nozzle for supplying fluid to at least a portion of the plurality of cutting elements. An opening is in the leading face. The opening leads to a passage which passes internally through the bit body to an outlet. A bearing member extends outwardly of the opening to at least a portion of the gauge region.

In accordance with still another aspect of the present invention, there is provided a rotary drill bit. The drill bit includes a bit body having a leading face. The leading face is arranged to accept a plurality of cutting elements thereon and to accept at least one nozzle for supplying fluid to at least a portion of the plurality of cutting elements. A plurality of openings are in the leading face. The plurality of openings lead to at least one passage which passes internally through the bit body to an outlet. A substantially continuous bearing member disposed about a peripheral portion of said bit body.

In accordance with yet another aspect of the present invention, there is provided a rotary drill bit. The drill bit includes a bit body having a leading face and a peripheral gauge region. A plurality of cutting elements are disposed on the leading face of the bit body. At least one nozzle is disposed in the bit body for supplying fluid to at least a portion of the plurality of cutting elements. An opening is in the leading face. The opening leads to a passage which passes internally through the bit body to an outlet. A bearing member extends outwardly from the opening to a portion of the gauge region.

In accordance with a further aspect of the present invention, there is provided a rotary drill bit. The drill bit includes a bit body having a meeting place and a peripheral gauge region. A plurality of nozzles are disposed in the bit body for supplying fluid to at least a portion of the leading face. A plurality of openings are in the leading face. Each of the plurality of openings leads to a respective passage which passes internally through the bit body to an outlet. A plurality of respective bearing members extend outwardly to the gauge region from each of the plurality of openings.

In accordance with an even further aspect of the present invention, there is provided a rotary drill bit for drilling a borehole. The drill bit includes a bit body having a leading face. A plurality of cutting elements is disposed on the leading face of the bit body. At least one nozzle is disposed in the bit body for supplying fluid to at least a portion of the plurality of cutting elements. There is a fluid passageway for receiving fluids supplied by the at least one nozzle. The fluid passageway is disposed internal in the bit body and extends from the leading face to a fluid outlet. A substantially continuous bearing member is disposed about a peripheral portion of the bit body.

In accordance with a still further aspect of the present invention, there is provided a rotary drill bit. The drill bit includes a bit body having a leading face. A plurality of cutting elements are disposed on the leading face of the bit body. A plurality of nozzles are disposed in the bit body for supplying fluid to at least a portion of the plurality of cutting elements. There are a plurality of fluid passageways for receiving fluids supplied by the plurality of nozzles. The plurality of fluid passageways is disposed internally in the bit body and extends from the leading face to a fluid outlet. A substantially continuous bearing member is disposed about a peripheral portion of the bit body.

In accordance with a yet further aspect of the present invention, there is provided a rotary drill bit for drilling a borehole. The drill bit includes a bit body having a leading face and a peripheral gauge region. A plurality of cutting elements are disposed on the leading face of the bit body. At least one nozzle is disposed in the bit body for supplying fluid to at least a portion of the plurality of cutting elements. There is a fluid passageway for receiving fluid from the at least one nozzle. The fluid passageway is disposed internally in the bit body and extends for the leading face to a fluid outlet. The portion of the peripheral gauge region extends outwardly from the fluid passageway to form a bearing surface. The bearing surface inhibits the flow of fluid from the at least one nozzle across the portion of the peripheral gauge region.

In accordance with another aspect of the present invention, there is provided a rotary drill bit for drilling a borehole. The drill bit includes a bit body having a leading face. A plurality of cutting elements are disposed on the leading face of the bit body. A plurality of nozzles are disposed in the bit body for supplying fluid to at least a portion of a plurality of cutting elements. There are a plurality of fluid passageways for receiving fluid from the plurality of nozzles. The plurality of fluid passageways are disposed internally in the bit body and extend from the leading face to a fluid outlet. A bearing member is disposed around a periphery of the bit body. The bearing member is adapted to bear against a wall of the borehole when in use.

In accordance with still another aspect of the present invention, there is provided a rotary drill bit for drilling a borehole. The drill bit includes a bit body having a leading face and a peripheral gauge region. A plurality of blades are disposed on the leading face. The plurality of blades extend outwardly toward the gauge region and form a plurality of fluid channels there between. A plurality of cutting elements are disposed on each of the plurality of blades. A plurality of nozzles are disposed in the bit body for supplying fluid to each of the fluid channels. There are a plurality of fluid passageways for receiving the fluid. Each of the plurality of fluid passageways is disposed internally in the bit body and extends from a respective fluid channel to a fluid outlet. A substantially continuous bearing member is disposed by the peripheral portion of the bit body.

In accordance with yet another aspect of the present invention, there is provided a rotary drill bit for drilling a borehole. The drill bit includes means for cutting the borehole, means for supplying fluid to the cutting means, means for channeling the fluid from the cutting means internally through the drill bit, and means for bearing against a wall of the borehole during use of the drill bit.

In accordance with a further aspect of the present invention, there is provided a rotary drill bit for drilling a borehole. The drill bit includes a bit body, means for cutting the borehole coupled to the bit body, means for supplying fluid to the cutting means, means for channeling the fluid from the cutting means internally through the bit body to an annulus between the bit body and the borehole, and means for bearing against a wall of the borehole.

In accordance with an even further aspect of the present invention, there is provided a rotary drill bit for drilling a borehole. The drill bit includes a bit body having a leading face and a peripheral gauge region. An opening is disposed in the leading face. The opening leads to a passage which passes internally through the bit body between the opening and an outlet. A bearing surface is disposed at a portion of the gauge region outwardly from the opening. The bearing surface introduces an offset in the drill bit whereby the bearing surface bears against a wall of the borehole during use of the drill bit.

In regard to specific embodiments, a nozzle is provided in the passage for supplying drilling fluid, and the nozzle may be at least partly directed towards the opening so as to deliver drilling fluid through the opening and into and inwardly along the one channel. Alternatively, the nozzle may be at least partly directly towards the outlet from the passage, so as to deliver drilling fluid through the outlet to the annulus. The nozzle may be mounted in a socket in a wall of the passage, the axis of the socket and of the nozzle being inclined with respect to the axis of the passage.

At least one nozzle for supplying drilling fluid may be so located on the bit body as to deliver to the one channel a supply of drilling fluid which flows outwardly along the channel towards the gauge region. The nozzle may be located in the one channel, for example adjacent the inner end thereof. Alternatively the one channel may be in communication with another channel defined between blades on the bit body, and a further nozzle for supplying drilling fluid may be so located on the bit body as to deliver to the other channel a supply of drilling fluid which flows first inwardly along the other channel and then outwardly along the one channel towards the opening. The further nozzle may be located adjacent the outer end of the other channel.

In any of these specific embodiments, each channel on the bit body which is not provided with an opening into an enclosed passage may lead at its outer extremity to an outwardly facing junk slot formed in the gauge section and leading to the annulus.

Alternatively, a plurality of the channels on the bit body may each be formed with an opening into an enclosed passage which passes internally through the bit body to an outlet which, in use, communicates with the annulus between the drill string and the wall of the borehole being drilled, a portion of the gauge region outwardly of each said opening comprising a bearing surface which, in use, bears against the wall of the bore hole and extend across the outer extremity of the respective channel.

In this case, the bearing surfaces at the outer extremities of adjacent channels formed with the openings are preferably connected to form a substantially continuous bearing surface extending across the combined widths of the adjacent channels.

All of the channels on the bit body may each be formed with an opening into an enclosed passage which passes internally through the bit body to an outlet which, in use, communicates with the annulus between the drill string and the wall of the bore hole being drilled, the portions of the gauge region outwardly of the openings comprising a substantially continuous bearing surface extending around substantially the whole of the gauge region.

In any of these embodiments at least one of the channels may be provided with a plurality of openings each of which leads into an enclosed passage which passes internally through the bit body to an outlet which, in use, communicates with the annulus between the drill string and the wall of the borehole being drilled, the portion of the gauge region outwardly of the the openings comprising a bearing surface which, in use, bears against the wall of the bore hole and extends across the width of the channel.

Each enclosed passage passing internally through the bit body may extend generally parallel to the longitudinal central axis of the drill bit.

BRIEF DESCRIPTION OF THE DRAWINGS

FIG. 6 is a perspective view of another embodiment of a drill bit in accordance with the present invention;

FIG. 7 is an end view of the drill bit shown in FIG. 6; and

FIG. 8 is a side view of the drill bit shown in FIG. 6.

DETAILED DESCRIPTION OF THE PREFERRED EMBODIMENTS

Figure 1:
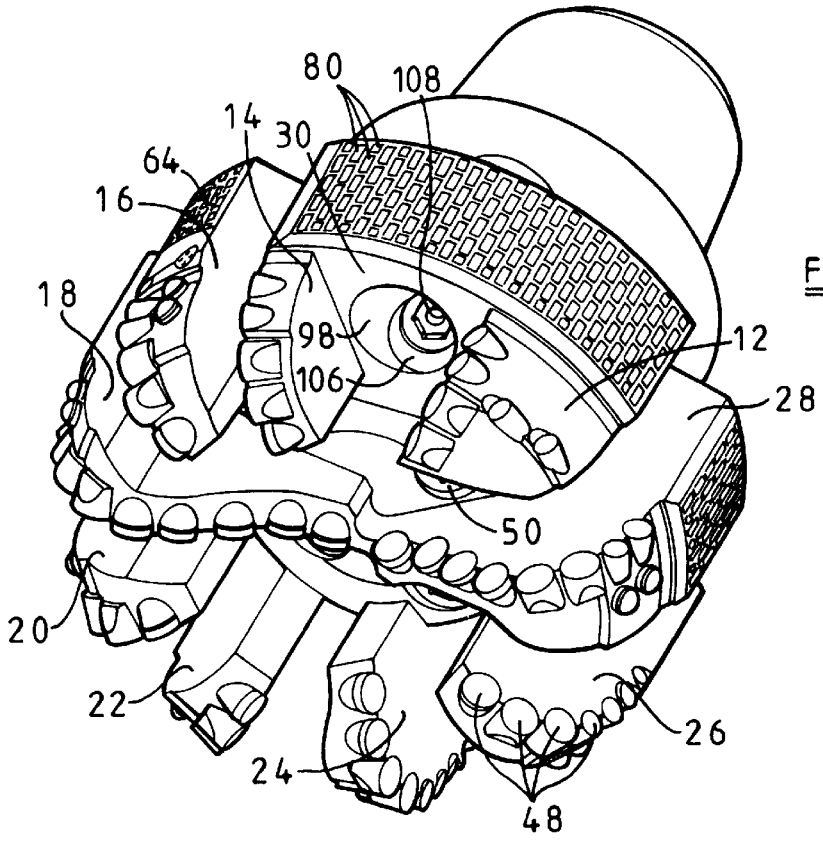
FIG. 1 is a perspective view of a PDC drill bit in accordance with the present invention.

Referring to the drawings, the drill bit comprises a bit body 10 and nine blades 12, 14, 16, 18, 20, 22, 24, 26 and 28 formed on the leading face of the bit and extending outwardly from the axis of the bit body 10 towards the gauge region 29. Between adjacent blades there are defined channels 30, 32, 34, 36, 38, 40, 42, 44 and 46.

Extending side-by-side along each of the blades are a plurality of cutting structures, indicated at 48. The precise nature of the cutting structures 48 does not form a part of the present invention and they may be of any appropriate type. For example, as shown, they may comprise circular preformed cutting elements brazed to cylindrical carriers which are embedded or otherwise mounted in the blades, the cutting elements each comprising a pre-formed compact having a polycrystalline diamond front cutting layer bonded to a tungsten carbide substrate, the compact being brazed to a cylindrical tungsten carbide carrier. In another form of cutting structure the substrate of the preformed compact is of sufficient axial length to be mounted directly in the blade, the additional carrier then being omitted.

Back-up abrasion elements or cutters 49 may be spaced rearwardly of some of the cutting structures, as shown.

Inner nozzles 50, 52, 54 are mounted in the surface of the bit body 10 and are located fairly close to the central axis of rotation of the bit. Each inner nozzle is so located that it can deliver drilling fluid to two or more channels. In addition, peripheral nozzles 56, 58 and 60 are located in the channels 34, 40 and 44 respectively and are oriented to direct drilling fluid inwardly along their respective channels towards the center of the drill bit. All of the nozzles communicate with a central axial passage (not shown) in the shank of the bit, to which drilling fluid is supplied under pressure downwardly through the drill string in known manner.

The outer extremities of the blades are formed with axially extending kickers 62, 64, 66, 68, 70, 72, 74, 76 and 78 respectively, which provide part-cylindrical bearing surfaces 79 which, in use, bear against the surrounding wall of the borehole and stabilize the bit in the borehole. Abrasion-resistant bearing elements 81, of any suitable known form, are embedded in the bearing surfaces 79.

Each of the channels 32, 34, 36, 38, 40, 42, 44, 46 leads to a respective junk slot 80, 82, 84, 86, 88, 90, 92, 94. The junk slots extend upwardly between the kickers, generally parallel to the central longitudinal axis of the drill bit, so that drilling fluid flowing outwardly along each channel passes into the associated junk slot and flows upwardly, between the bit body and the surrounding formation, into the annulus between the drill string and the wall of the borehole.

Figure 3:
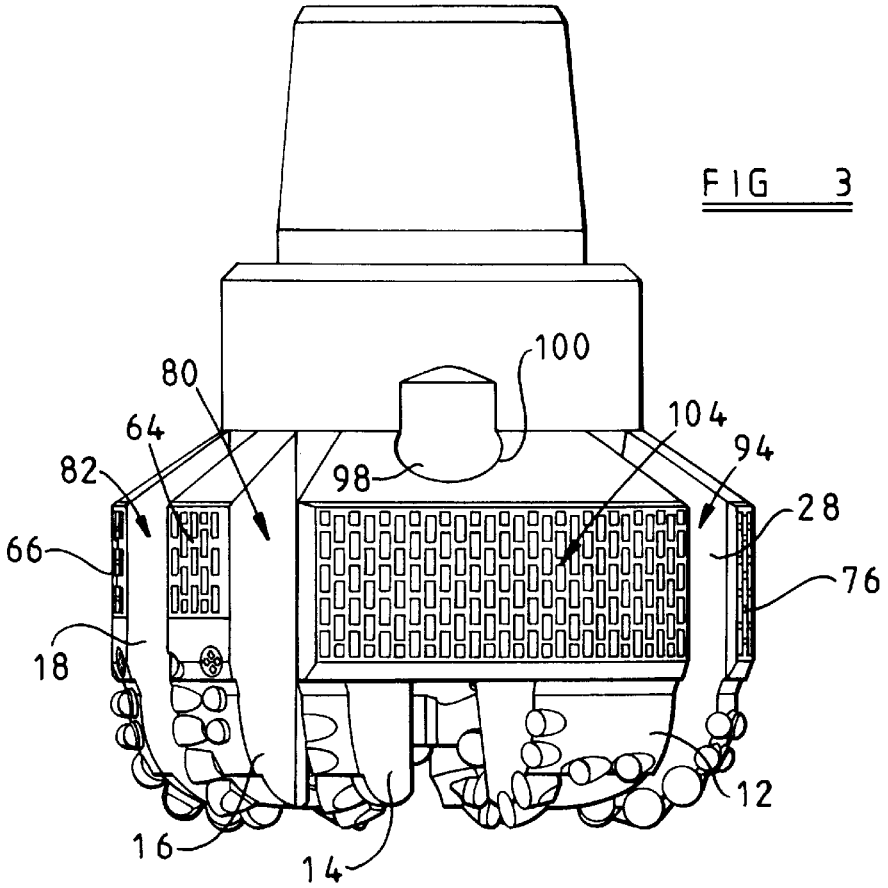
FIG. 3 is a side elevation of the drill bit.

In accordance with the present invention the channel 30 between the blades 12 and 14 does not lead to a conventional junk slot but continues right up to the gauge region 29 of the drill bit. Formed in the channel 30 adjacent the gauge region 29 is a circular opening 96 into an enclosed cylindrical passage 98 which extends through the bit body 10 to an outlet 100 (see FIG. 3) which communicates with the annulus.

The bearing surfaces 78 and 62 at the outer extremities of the blades 12 and 14 are connected by an intermediate bearing member 101 having a bearing surface 102 which extends across the width of the channel 30 so as to form, with the bearing surfaces 78 and 62, a large continuous part-cylindrical bearing surface 104.

As best seen in FIG. 1, a cylindrical socket 106 is formed in the side wall of the passage 98 and is inclined at an angle to the longitudinal axis of the passage 98. A nozzle 108 is mounted in the socket 106 and is angled to direct drilling fluid along the passage 98 towards the opening 96, so that the drilling fluid emerges from the opening 96 and flows inwardly along the channel 30.

Figure 2:
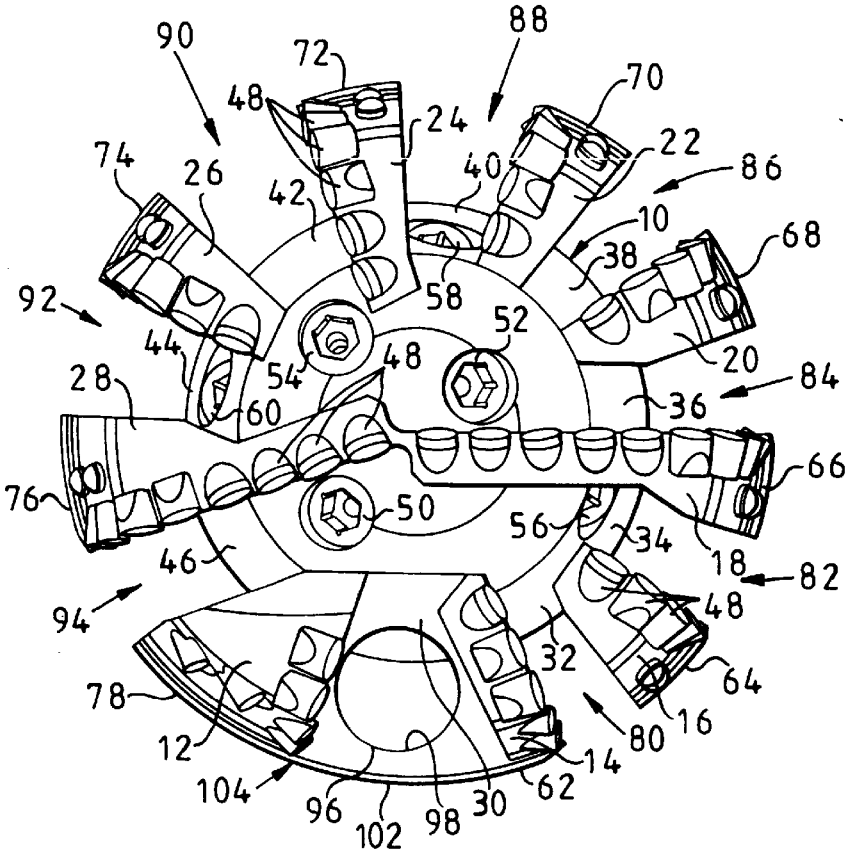
FIG. 2 is an end view of the drill bit shown in FIG. 1.

Thus, in the case of the channel 30, the conventional junk slot is replaced by the enclosed passage 98 which passes internally through the bit body 10. This enables the provision on the adjacent part of the gauge region 29 of a bearing surface 104 of extended peripheral extent, and this increased bearing surface may enhance the stability of the drill bit in the borehole. As can be seen from a study of the drawings, particularly FIG. 2, the portion of the drill bit having the bearing surfaces 78 and 62 of the blades 12 and 14 coupled by the bearing member 101 provides an extended bearing surface 104 of increased circumferential length. It will be appreciated that the provision of such extended surface may hinder or prevent the phenomenon of bit whirl, as is well known in the art, because, as previously mentioned, the bit is also arranged to be subject, in use, to a resultant lateral force which urges the extended bearing surface 104 against the wall of the borehole.

Figure 4:
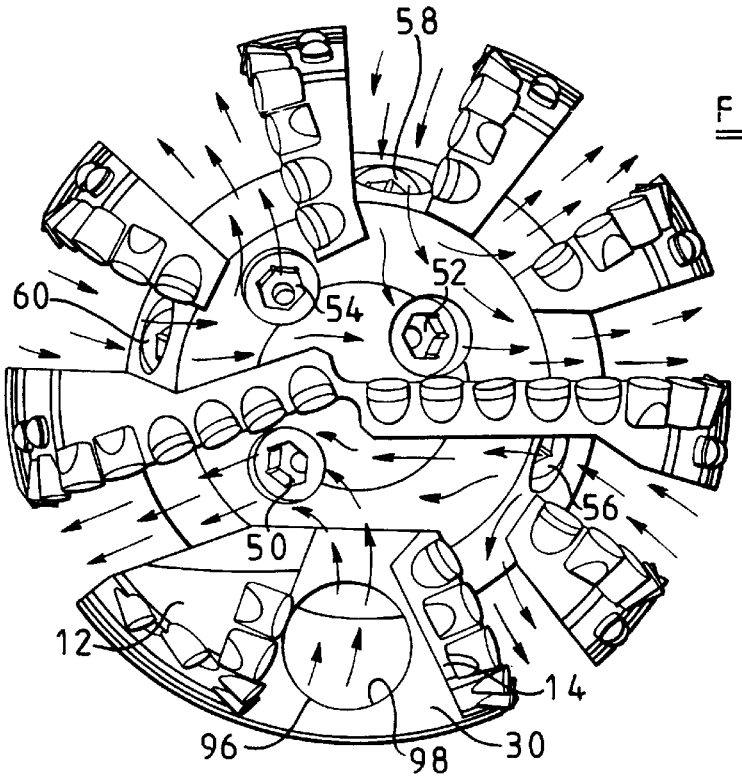
FIG. 4 is a similar view to FIG. 2 showing diagrammatically the hydraulic flow over the surface of the drill bit.

FIG. 4 shows diagrammatically a typical pattern of flow of drilling fluid over the face of the bit. It will be seen that drilling fluid flows inwardly, as indicated by the arrows, from the peripheral nozzles 108, 56, 58 and 60 towards the center of the bit and then across the face of the bit to flow outwardly along other channels, the outward flow being reinforced by the flow from the inner nozzles 50, 52, 54.

However, other flow patterns are possible and may be achieved by appropriate location and orientation of the nozzles. For example, the nozzle 108 in the passage 98 may be oriented so as to direct a flow of drilling fluid upwardly through the passage 98 towards the outlet 100, in which case the flow along the channel 30 will be in an outward direction towards the opening 96. Alternatively, the nozzle 108 may be omitted altogether, and in this case also drilling fluid will flow outwardly along the channel 30, such flow being derived, for example, from the nozzles 50 and 56.

Figure 5:
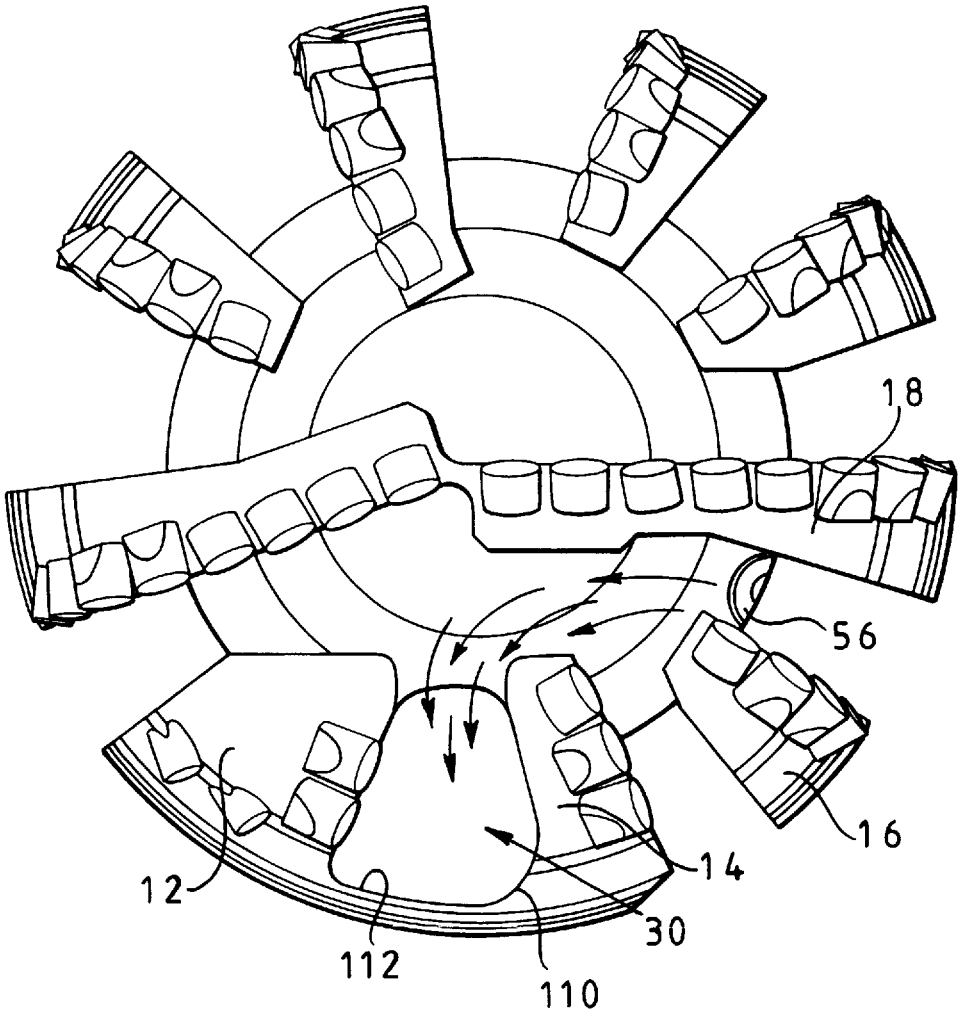
FIG. 5 is a similar view to FIG. 2 of an alternative form of drill bit in accordance with the invention.

FIG. 5 shows an alternative arrangement where the opening 110 into the passage 112 is irregularly shaped so as to extend over almost all of the entire area of the channel 30 between the blades 12 and 14. In this case a nozzle is not provided in the passage 112 and the flow of drilling fluid along the channel 30 and through the passage 112 is derived from the peripheral nozzle 56, as indicated by the arrows in FIG. 5.

FIGS. 1 to 4 show an enclosed passage in only one of the channels. However, the invention includes within its scope arrangements in which two or more of the channels do not lead to conventional open junk slots but are closed at their outer extremity by a bearing surface in the gauge region, there being provided in each channel an enclosed passage, similar to the passage 98, which passes through the bit body. It will be appreciated that for each channel which is constructed in this manner the overall bearing surface area of the gauge region will be increased. In some cases it may be desirable to replace all the junk slots by enclosed passages similar to the passage 98, in which case the whole of the gauge region of the drill bit will comprise a continuous and uninterrupted 360° bearing surface engaging the wall of the borehole.

Although the passage 98 is described as being a cylindrical passage parallel to the longitudinal axis of the drill bit, other arrangements are possible. For example, the passage may vary in cross-sectional shape and/or diameter along its length. Two or more openings may be provided in the channel, the openings leading to separate passages through the bit body, or two or more openings may lead into a single passage.

One such bit having A substantially continuous bearing surface extending around substantially the whole of the gauge region is illustrated in FIGS. 6–8. Like the drill bit illustrated in FIGS. 1–5, the drill bit includes a bit body 120 and eight blades 122 formed on the leading face of the bit and extending outwardly from the axis of the bit body towards the gauge region. Between adjacent blades 122 there are defined channels 124.

Extending side-by-side along each of the blades 122 is a plurality of cutting structures 126. Each cutting structure 126 includes a preformed cutting element brazed to a cylindrical carrier which is embedded or otherwise mounted in one of the blades 122. Each cutting element may include a preformed compact having a polycrystalline diamond front cutting table which is bonded, by brazing for instance, to a tungsten carbide substrate. Alternatively, the substrate of the preformed compact may be of sufficient axially length to be mounted directly in the blade, so that the additional carrier may then be omitted.

The gauge region 128 of the bit body includes a continuous bearing surface 134 that extends around the whole of the gauge region. Like the drill bit illustrated in FIGS. 1–5, gauge protection is provided by inserts (not shown) that may include a mixture of polycrystalline diamond compacts and diamonds inserts. Inner nozzles 138 are mounted in the surface of the bit body 120 and are located fairly close to the central access of rotation of the bit. The inner nozzles 138 are positioned to give efficient cleaning in the central region of the bit and are also directed to deliver drilling fluid along the channels 124 so as to clean and cool the cutting elements 126 mounted on the blades 122.

The channels 124 between the blades 122 do not lead to conventional junk slots which extend upwardly through the gauge region 128. Rather, the channels 124 continue right up to the continuous bearing surface of the gauge region 128. A shaped opening 140 is formed in each channel 124 adjacent the gauge region 128. The opening 140 leads to an enclosed passage 142 which extends through the bit body 120 to an outlet 144, as illustrated in FIG. 8. The passage 142 communicates, in use, with the annulus between the drill string and the surrounding formation forming the walls of the borehole.

FIG. 5 shows an alternative arrangement where the opening 110 into the passage 112 is irregularly shaped so as to extend over almost all of the entire area of the channel 30 between the blades 12 and 14. In this case a nozzle is not provided in the passage 112 and the flow of drilling fluid along the channel 30 and through the passage 112 is derived from the peripheral nozzle 56, as indicated by the arrows in FIG. 5.

We claim:

1. A rotary drill bit for drilling a borehole, said drill bit comprising:

a bit body having a leading face and a peripheral gauge region;

an opening disposed in said leading face, said opening leading to passage passing internally through said bit body between said opening and an outlet; and a bearing surface disposed at a portion of said gauge region outwardly from said opening.

2. The drill bit, as set forth in claim 1, further comprising:

a plurality of blades disposed on said leading face, said plurality of blades extending outwardly toward said gauge region and forming a plurality of fluid channels therebetween;

a plurality of cutting elements disposed on each of said plurality of blades; and at least one nozzle disposed in said bit body for supplying fluid to each of said fluid channels.

3. The drill bit, as set forth in claim 2, wherein said opening receives fluid supplied by said at least one nozzle.

4. The drill bit, as set forth in claim 2, wherein said opening is disposed in one of said plurality of fluid channels to receive fluid supplied by said at least one nozzle.

5. The drill bit, as set forth in claim 1, wherein said bearing surface inhibits fluid flow across said portion of said gauge region.

6. The drill bit, as set forth in claim 1, wherein said bearing surface bears against a wall of said borehole when in use.

7. The drill bit, as set forth in claim 1, wherein said bearing surface extends around all of said gauge region.

8. A rotary drill bit comprising:

a bit body having a leading face and a peripheral gauge region, said leading face being arranged to accept a plurality of cutting elements thereon and to accept at least one nozzle for supplying fluid to at least a portion of said plurality of cutting elements;

an opening in said leading face, said opening leading to a passage passing internally through said bit body to an outlet; and a bearing member extending outwardly of said opening to at least a portion of said gauge region.

9. The drill bit, as set forth in claim 8, further comprising:

a plurality of blades disposed on said leading face, said plurality of blades extending outwardly toward said gauge region and forming a plurality of fluid channels therebetween, said plurality of cutting elements being disposed on said plurality of blades, and said at least one nozzle being disposed in said bit body for supplying fluid to at least one of said plurality said fluid channels.

10. The drill bit, as set forth in claim 9, wherein said opening is disposed in one of said plurality of fluid channels to receive fluid supplied by said at least one nozzle.

11. The drill bit, as set forth in claim 8, wherein said bearing member inhibits fluid flow across said portion of said gauge region.

12. The drill bit, as set forth in claim 8, wherein said bearing member bears against a wall of said borehole when in use.

13. The drill bit, as set forth in claim 8, wherein said bearing member extends around all of said gauge region.

14. A rotary drill bit comprising:

a bit body having a leading face, said leading face being arranged to accept a plurality of cutting elements thereon and to accept at least one nozzle for supplying fluid to at least a portion of said plurality of cutting elements;

a plurality of openings in said leading face, said plurality of openings leading to at least one passage passing internally through said bit body to an outlet; and a substantially continuous bearing member disposed about a peripheral portion of said bit body.

15. The drill bit, as set forth in claim 14, further comprising:

a plurality of blades disposed on said leading face, said plurality of blades extending outwardly toward said peripheral portion of said bit body and forming a plurality of fluid channels therebetween, said plurality of cutting elements being disposed on said plurality of blades, and said at least one nozzle being disposed in said bit body for supplying fluid to at least one of said plurality fluid channels.

16. The drill bit, as set forth in claim 15, wherein one of said plurality of openings is disposed in each of said plurality of fluid channels to receive fluid supplied by said at least one nozzle.

17. The drill bit, as set forth in claim 14, wherein said bearing member inhibits fluid flow across said peripheral portion of said bit body.

18. The drill bit, as set forth in claim 14, wherein said bearing member bears against a wall of said borehole when in use.

19. A rotary drill bit comprising:

a bit body having a leading face and a peripheral gauge region;

a plurality of cutting elements being disposed on said leading face of said bit body;

at least one nozzle disposed in said bit body for supplying fluid to at least a portion of said plurality of cutting elements;

an opening in said leading face, said opening leading to a passage passing internally through said bit body to an outlet; and a bearing member extending outwardly from said opening to a portion of said gauge region.

20. The drill bit, as set forth in claim 19, further comprising:

a plurality of blades disposed on said leading face, said plurality of blades extending outwardly toward said gauge region and forming a plurality of fluid channels therebetween, said plurality of cutting elements being disposed on said plurality of blades, and said at least one nozzle being disposed in said bit body for supplying fluid to at least one of said plurality of fluid channels.

21. The drill bit, as set forth in claim 20, wherein said opening is disposed in one of said plurality of fluid channels to receive fluid supplied by said at least one nozzle.

22. The drill bit, as set forth in claim 19, wherein said bearing member inhibits fluid flow across said portion of said gauge region.

23. The drill bit, as set forth in claim 19, wherein said bearing member bears against a wall of said borehole when in use.

24. The drill bit, as set forth in claim 19, wherein said bearing member is substantially continuous along said gauge region.

25. A rotary drill bit comprising:

a bit body having a leading face and a peripheral gauge region;

a plurality of nozzles disposed in said bit body for supplying fluid to at least a portion of said leading face;

a plurality of openings in said leading face, each of said plurality of openings leading to a respective passage passing internally through said bit body to an outlet; and a plurality of respective bearing members extending outwardly to said gauge region from each of said plurality of openings.

26. The drill bit, as set forth in claim 25, further comprising:

a plurality of blades disposed on said leading face, said plurality of blades extending outwardly toward said gauge region and forming a plurality of fluid channels therebetween, wherein said plurality of nozzles are arranged in said bit body for supplying fluid to said plurality of fluid channels.

27. The drill bit, as set forth in claim 26, wherein one of said plurality of openings is disposed in a respective one of said plurality of fluid channels to receive said fluid.

28. The drill bit, as set forth in claim 25, wherein each of said plurality of respective bearing members inhibits fluid flow across said gauge region.

29. The drill bit, as set forth in claim 25, wherein each of said plurality of respective bearing members is adapted to bear against a wall of said borehole when in use.

30. The drill bit, as set forth in claim 25, wherein said plurality of respective bearing members form a substantially continuous bearing surface along said gauge region.

31. A rotary drill bit for drilling a borehole, said drill bit comprising:

a bit body having a leading face;

a plurality of cutting elements disposed on said leading face of said bit body;

at least one nozzle disposed in said bit body for supplying fluid to at least a portion of said plurality of cutting elements;

a fluid passageway for receiving fluid supplied by said at least one nozzle, said fluid passageway disposed internally in said bit body and extending from said leading face to a fluid outlet; and a substantially continuous bearing member disposed about a peripheral portion of said bit body.

32. The drill bit, as set forth in claim 31, further comprising:

a plurality of blades disposed on said leading face, said plurality of blades extending outwardly toward said peripheral portion of said bit body and forming a plurality of fluid channels therebetween, said plurality of cutting elements being disposed on said plurality of blades, and said at least one nozzle being disposed in said bit body for supplying fluid to at least one of said plurality of fluid channels.

33. The drill bit, as set forth in claim 32, wherein said fluid passageway is disposed in one of said plurality of fluid channels to receive said fluid.

34. The drill bit, as set forth in claim 31, wherein said bearing member inhibits fluid flow across said peripheral portion of said bit body.

35. The drill bit, as set forth in claim 31, wherein said bearing member bears against a wall of said borehole when in use.

36. A rotary drill bit comprising:

a bit body having a leading face;

a plurality of cutting elements disposed on said leading face of said bit body;

a plurality of nozzles disposed in said bit body for supplying fluid to at least a portion of said plurality of cutting elements;

a plurality of fluid passageways for receiving fluid supplied by said plurality of nozzles, said plurality of fluid passageways disposed internally in said bit body and extending from said leading face to a fluid outlet; and a substantially continuous bearing member disposed about a peripheral portion of said bit body.

37. The drill bit, as set forth in claim 36, further comprising:

a plurality of blades disposed on said leading face, said plurality of blades extending outwardly toward said peripheral portion of said bit body and forming a plurality of fluid channels therebetween, said plurality of cutting elements being disposed on said plurality of blades, and said plurality of nozzles being disposed in said bit body for supplying fluid to each of said fluid channels.

38. The drill bit, as set forth in claim 37, wherein respective one of said plurality of fluid passageways is disposed in each of said plurality of fluid channels to receive said fluid.

39. The drill bit, as set forth in claim 36, wherein said bearing member inhibits fluid flow across said peripheral portion of said bit body.

40. The drill bit, as set forth in claim 36, wherein said bearing member bears against a wall of said borehole when in use.

41. A rotary drill bit for drilling a borehole, said drill bit comprising:

a bit body having a leading face and a peripheral gauge region;

a plurality of cutting elements disposed on said leading face of said bit body;

at least one nozzle disposed in said bit body for supplying fluid to at least a portion of said plurality of cutting elements;

a fluid passageway for receiving fluid from said at least one nozzle, said fluid passageway disposed internally in said bit body and extending from said leading face to a fluid outlet; and a portion of said peripheral gauge region extending outwardly from said fluid passageway forming a bearing surface, said bearing surface inhibiting flow of fluid from said at least one nozzle across said portion of said peripheral gauge region.

42. A rotary drill bit for drilling a borehole, said drill bit comprising:

a bit body having a leading face;

a plurality of cutting elements being disposed on said leading face of said bit body;

a plurality of nozzles disposed in said bit body for supplying fluid to at least a portion of said plurality of cutting elements;

a plurality of fluid passageways for receiving fluid from said plurality of nozzles, said plurality of fluid passageways disposed internally in said bit body and extending from said leading face to a fluid outlet; and a bearing member disposed around a periphery of said bit body, said bearing member being adapted to bear against a wall of said borehole when in use.

43. A rotary drill bit for drilling a borehole, said drill bit comprising:

a bit body having a leading face and a peripheral gauge region;

a plurality of blades disposed on said leading face, said plurality of blades extending outwardly toward said gauge region and forming a plurality of fluid channels therebetween;

a plurality of cutting elements disposed on each of said plurality of blades;

a plurality of nozzles disposed in said bit body for supplying fluid to each of said fluid channels;

a plurality of fluid passageways for receiving said fluid, each of said plurality of fluid passageways disposed internally in said bit body and extending from a respective fluid channel to a fluid outlet; and a substantially continuous bearing member disposed about a peripheral portion of said bit body.

44. A rotary drill bit for drilling a borehole, said drill bit comprising:

means for cutting said borehole;

means for supplying fluid to said cutting means;

means for channeling said fluid from said cutting means internally through said drill bit; and means for bearing against a wall of said borehole during use of said drill bit.

45. A rotary drill bit for drilling a borehole, said drill bit comprising:

a bit body;

means for cutting said borehole coupled to said bit body;

means for supplying fluid to said cutting means;

means for channeling said fluid from said cutting means, internally through said bit body, to an annulus between said bit body and said borehole; and means for bearing against a wall of said borehole.

46. A rotary drill bit for drilling a borehole, said drill bit comprising:

a bit body having a leading face and a peripheral gauge region;

an opening disposed in said leading face, said opening leading to a passage passing internally through said bit body between said opening and an outlet; and a bearing surface disposed at a portion of said gauge region outwardly from said opening, said bearing surface introducing an offset in said drill bit whereby said bearing surface bears against a wall of said borehole during use of said drill bit.

47. The drill bit, as set forth in claim 46, further comprising:

a plurality of blades disposed on said leading face, said plurality of blades extending outwardly toward said gauge region and forming a plurality of fluid channels therebetween;

a plurality of cutting elements disposed on each of said plurality of blades; and at least one nozzle disposed in said bit body for supplying fluid to each of said fluid channels.

48. The drill bit, as set forth in claim 47, wherein said opening receives fluid supplied by said at least one nozzle.

49. The drill bit, as set forth in claim 47, wherein said opening is disposed in one of said plurality of fluid channels to receive fluid supplied by said at least one nozzle.

50. The drill bit, as set forth in claim 46, wherein said bearing surface inhibits fluid flow across said portion of said gauge region.

51. The drill bit, as set forth in claim 46, wherein said bearing surface hinders bit whirl.

52. The drill bit, as set forth in claim 46, wherein said bearing surface extends around substantially all of said gauge region.

* * * * *